United States Patent [19]

Fowler

[11] 4,451,994

[45] Jun. 5, 1984

[54] RESILIENT MIDSOLE COMPONENT FOR FOOTWEAR

[76] Inventor: Donald M. Fowler, 271 Rock Ave., Golden, Colo. 80401

[21] Appl. No.: 382,178

[22] Filed: May 26, 1982

[51] Int. Cl.[3] ..... A43B 13/18

[52] U.S. Cl. ..... 36/28; 36/29; 36/102

[58] Field of Search ..... 36/28, 29, 35 B, 102, 36/3 B, 44

[56] References Cited

U.S. PATENT DOCUMENTS

| | | | |
|---|---|---|---|
| 1,596,923 | 8/1926 | Cooney | 36/29 |
| 2,950,118 | 8/1960 | Sharpe | 36/28 |
| 2,968,105 | 1/1961 | Rizzo | 36/29 |
| 3,834,046 | 9/1974 | Fowler | 36/28 |

FOREIGN PATENT DOCUMENTS

| | | | |
|---|---|---|---|
| 2642946 | 3/1978 | Fed. Rep. of Germany | 36/29 |
| 43172 | 3/1908 | Switzerland | 36/29 |

*Primary Examiner*—Werner H. Schroeder
*Assistant Examiner*—Steven N. Meyers
*Attorney, Agent, or Firm*—John E. Reilly

[57] ABSTRACT

A shock-absorbing midsole component in footwear is disclosed and is made up of spaced upper and lower flexible coextensive layers having a closure strip extending therearound and sealing the layers to form a sealed air space therebetween. A plurality of support ribs extend in spaced relation to each other between the layers and through the interior air space. A one-piece molding process is employed in forming the layers, ribs and common diaphragm of the interior air space. The closure strip is a one-piece element united into an outer peripheral groove formed in surrounding relation to the ribs and diaphragm between the layers.

15 Claims, 5 Drawing Figures

RESILIENT MIDSOLE COMPONENT FOR FOOTWEAR

This invention relates to shock-absorbing members, and more particularly relates to a novel and improved cushioning device for footwear.

BACKGROUND AND FIELD OF THE INVENTION

Numerous designs have been advanced in an attempt to develop a cushioning device for footwear which is both protective and resilient, which yields and flexes to the degree necessary for comfort yet has sufficient stability and resistance to absorb impact and provide a supportive shield between foot and ground. The addition of an intermediate sole structure, filler, or padding has been employed in the past to minimize muscular and skeletal stress and attendant fatigue experienced in the feet and legs after standing or walking for long periods of time.

Early cushioning shoe sole designs are disclosed in U.S. Pat. Nos. 2,055,072 to Everston and 2,401,088 to Lumbard. The former employs thin plies of sponge rubber or the like layered between insole, midsole, and outer sole at heel, arch and ball areas. While the pads provide some cushioning, they are necessarily thin and only minor impact is required to compress them to a point at which they are no longer protective. The sole described in the latter patent employs two-ply fillers comprising a fibrous material cemented to a cushioning elastic material. Again, the materials and structure are such that this type of sole will withstand but a limited range of pressure or impact before full compression is reached. In more recent approaches to midsole construction, the development of layering techniques and the use of more resilient materials have resulted in soles which respond gradually and progressively to a greater range of compressive forces, thus providing more effective cushioning in a wider variety of situations. An example of this type of midsole structure is taught in my U.S. Pat. No. 3,834,046, granted Sept. 10, 1974. The shoe sole of my earlier invention comprises flexible upper and lower sheets formed with a plurality of complementary aligned ridges and channels, respectively. The ridges and channels are separated by an elastic diaphragm which yieldingly resists the compressive movement of the ridges into the open channels upon impact of the shoe against the ground. It is believed that the midsole structure of the present invention constitutes an improvement over the art of record, including that set forth in my earlier patent, as will be more clearly demonstrated hereinbelow.

SUMMARY OF INVENTION

It is therefore an object of the present invention to provide for a novel and improved resilient and supportive member adapted to be placed between the insole and outer, ground-engaging sole of a shoe in order to protect the foot from compressive forces and minimize the strain and fatigue resulting therefrom.

It is another object of the present invention to provide for a midsole structure for footwear which efficiently absorbs a broad range of compressive forces encountered in walking and running, and readily adapts its shock-absorbing qualities to different surfaces, speeds and gaits, as well as to the weight of the wearer.

It is further object of the present invention to provide for a novel and improved cushioning midsole in which an elastic material in combination with channels or air pockets yield progressively as greater compressive forces are applied; and further wherein the air pressure within the midsole is evenly distributed and can be regulated by the wearer to establish optimum comfort.

It is yet another object of the present invention to provide a novel and improved method and means for constructing a midsole which requires a minimum number of steps and components, is durable and comfortable in use and readly conformable for footwear of different types and construction.

It is still another object of the present invention to provide a novel and improved shock-absorbing member which is capable of resisting collapse under compressive applied forces, and further resists both front-to-back and lateral shifting, thereby providing a shock-absorbing structure which is stable yet resilient and flexible.

An additional object of the present invention is to provide an impact-absorbing, self-adjusting structure containing a plurality of air spaces in which the pressure therein can be regulated and corrected for variations in altitude, applied forces or weight by one or more valves located in communication with the interior air spaces of the structure.

In attaining the foregoing and other objects, this invention broadly comprises a shock-absorbing member adaptable for use as a midsole component in footwear or shoes wherein the member is made up of spaced upper and lower flexible closure sheets coextensive with one another, a closure strip extending around outer peripheral edges of said upper and lower layers and in sealed relation thereto so as to form a sealed air space between said layers, and a plurality of support ribs extend in spaced relation to one another between the sheets and through the interior air space. Preferably, the sealed air space is formed into upper and lower compartments by an intermediate diaphraghm which is coextensive with the upper and lower flexible closure sheets, the diaphragm being separated from the upper and lower closure layers by the spaced support ribs, the ribs traversing the substantial width of the structure and alternate ribs being disposed on and joined on opposite sides or surfaces of the diaphragm.

The construction described lends itself extremely well to a one-piece molding process in which the closure layers, ribs and common diaphragm therebetween are united. In its application to a shoe, the shock-absorbing member is coextensive with the bottom or heel and sole of the shoe with the closure layers and diaphragm being of the same approximate thickness and shape to extend continuously between the shoe insole and wearing sole. The outer peripheral closure strip is molded as a one-piece element and united by insertion into an outer peripheral groove formed in surrounding relation to the ribs and diaphragm between the upper and lower closure layers. Preferably, the ribs terminate at points spaced from the peripheral edge of the closure strip so as to establish communication between the air pockets throughout each compartment formed above and below the diaphragm. Further, the compartments formed above and below the diaphragm may communicate with one another such that air may be transferred between the upper and lower compartments and between the air pockets as localized pressure is applied to one portion of the member and redistributed through areas of lesser pressure. The ribs are so defined as to resist collapse under compressive applied forces yet at the same time resist laterally or longitudinally directed shifting between the closure layers. In turn, the closure layers and diaphragm are capable of stretching under applied loads and of efficiently transferring and absorbing applied loads or forces by virtue of their unitary construction with the support ribs as described. A further feature of the present invention resides in the utilization of regulating valve means in communication with one or more compartments to permit selective introduction of air under pressure so as to regulate the air pressure within the member and its resultant flexibility and resistance to applied forces. Specifically, the valve regulating means will permit the wearer to regulate the air pressure for optimum comfort and, for example, to compensate for temperature changes or variations in altitude.

The above and other objects, advantages and features of the present invention will be more readily appreciated and understood from the following description when taken together with the accompanying drawings in which:

DETAILED DESCRIPTION OF THE DRAWINGS

DETAILED DESCRIPTION OF THE PREFERRED EMBODIMENT

Figure 1:
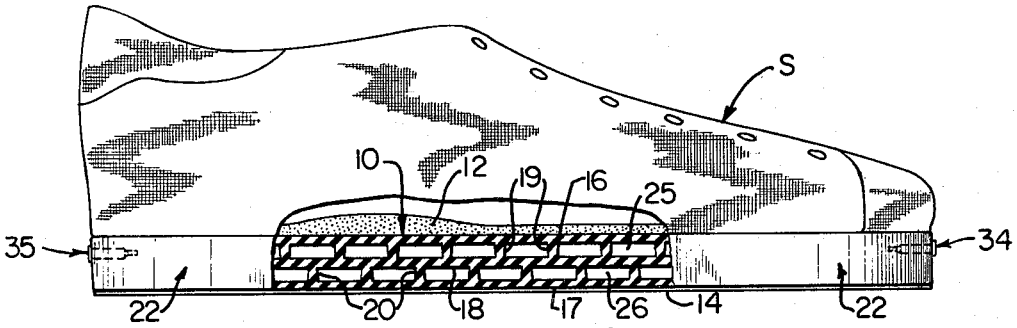
FIG. 1 is a side view in elevation of a preferred form of midsole component incorporated into a shoe structure in accordance with the present invention.
Figure 2:
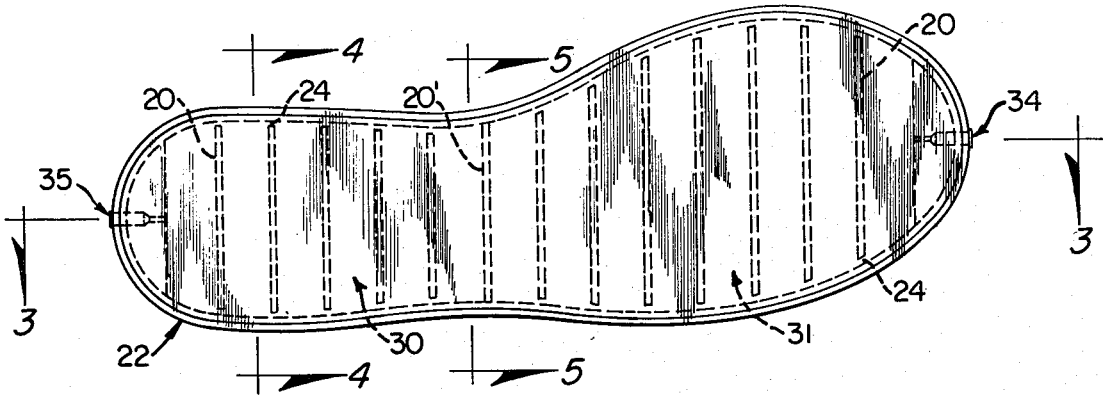
FIG. 2 is a bottom plan view in elevation of the preferred form of midsole component illustrated in FIG. 1.
Figure 3:
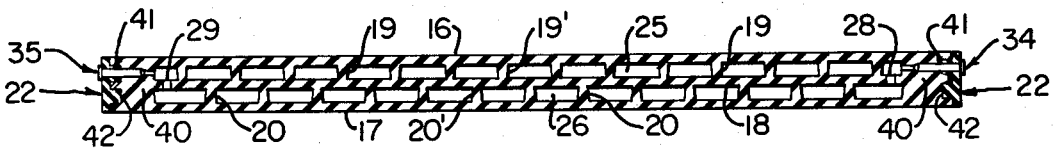
FIG. 3 is a cross-sectional view taken about lines 3—3 of FIG. 2.
Figure 4:
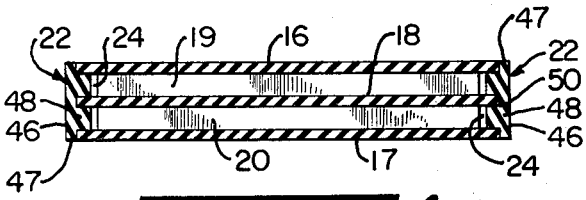
FIG. 4 is a cross-sectional view taken about lines 4—4 of FIG. 2.
Figure 5:
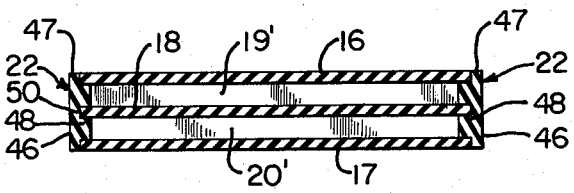
FIG. 5 is a cross-sectional view taken about lines 5—5 of FIG. 2.

Referring in detail to the drawings, the present invention is best typified by reference to its use as a shock or impact-absorbing member in a walking shoe. Preferably, the shock-absorbing member takes the form of a midsole component 10 which is interpositioned between an insole 12 and a lower or surface-engaging sole 14 of a standard shoe as designated at S. In this setting, the midsole component 10 is coextensive with the insole 12 and sole 14, the component 10 being broadly comprised of flexible upper and lower closure layers or sheets 16 and 17, respectively, which are connected to and spaced from a resilient intermediate diaphragm 18 by a plurality of upper and lower support ribs or bars 19 and 20, respectively. An outer peripheral closure strip 22 encircles the entire midsole component and is formed to extend continuously between outer peripheral edges of the upper and lower closure layers 16 and 17 so as to define a sealed air space therebetween. The upper and lower support ribs 19 and 20, in turn, serve to separate the intermediate diaphragm 18 from the upper and lower closure layers as well as to separate the air space into a plurality of air pockets through which air can be circulated and redistributed in response to the application of compressive force to the component.

The transversely extending ribs 19 and 20 are dimensioned to terminate a measured distance from the inner peripheral surface of the closure strip so as to form a limited lateral clearance space 24 which establishes communication between air pockets 25 and 26, respectively, between the ribs and the upper and lower compartments. In other words, the air pockets 25 formed between the ribs 19 in the upper compartment communicate with one another, and the air pockets 26 formed between ribs 20 in the lower compartment communicate with one another. If desired, limited communication may be established between upper and lower compartments by openings 28, 29 at opposite front and rear ends of the midsole component.

The midsole component may be further separated into heel and toe sections or compartments 30, 31, respectively, by a pair of upper and lower ribs 19' and 20' which traverse the entire width of the air space or, in other words, become united and sealed with the inner peripheral edge of the closure strip. In addition, conventional valve stems as represented at 34 and 35 at opposite front and rear ends of the midsole component are in communication with the interior air spaced formed within the upper compartment so as to permit the introduction of air under pressure into that air space. The valve stem is of the type conventionally employed in inflatable intems, such as, basketballs whereby air can be pumped into each valve by depression of the valve stem; or, if desired, can be removed by depression of the valve stem at each end.

Considering in more detail the construction and arrangement of the midsole component, each of the upper and lower layers 16, 17 and the intermediate diaphragm 18 is of uniform thickness, the diaphragm 18 being equally spaced between the upper and lower layers 16 and 17 by the support ribs 19 and 20. Depending upon the characteristics of the material employed, each rib is given a cross-sectional width such that it will resist bending but instead will compress under applied weight. Preferably, each set of support ribs 19 and 20 are uniformly spaced throughout the length of the midsole component, each rib being of uniform width or thickness throughout and that thickness substantially corresponding to the thickness of the upper and lower layers 16 and 17. Again both the thickness and spacing of the ribs may be varied, for example, to lend greater resistance to applied weight in selected areas, such as, the heel. The outer peripheral edge portion formed between the upper and lower layers is recessed or formed with a lateral clearance 24 as described to accommodate the closure strip along opposite sides of the midsole component; however, at opposite ends of the component, generally web-like supports 40 extend between the upper and lower ribs 19 and 20 with the forward and rearward edges of the diaphragm united to an intermediate portion of each support web 40. The external surface of each support 40 is divided into upper and lower grooves by a horizontal rib 41. The closure strip 22 is preferably composed of a relatively thick, elongated resilient body having an exterior section 46 of a width to traverse the space between the upper and lower layers 16 and 17 and to overlap the peripheral edges of the layers 16 and 17 as at 47. The intermediate section of the closure strip as designated at 48 projects between the upper and lower layers 16 and 17 and is divided into upper and lower spaced ridges by a central groove 50 which is of a width to receive the outer peripheral edge of the intermediate diaphragm 18 as well as the external ribs 41 of the webs 40. The ridges formed between the diaphragm 18 and the upper and lower layers 16 and 17 project a distance to terminate short of the ends of the ribs 19 and 20 so as to form the lateral clearance space 24 as earlier described to permit air to circulate around the ends of the ribs between adjacent air pockets or channels. If desired, the communication between adjacent air pockets may be selectively controlled or limited by regulating the length of the ribs so that certain of the ribs will directly engage the inner peripheral surface of the closure strip, such as, in the manner described with reference to the intermediate ribs 19' and 20'. The closure strip is united to the layers 16, 17 and the diaphragm 18 separately by application of a suitable bonding agent or adhesive therebetween, such as, a thermal setting rubber cement so as to form a sturdy, air-tight structure.

A preferred method of manufacturing the resilient midsole component is to mold the article in two steps: The construction of the upper and lower layers 16, 17, diaphragm 18 and support ribs 19, 20 as well as the end supports or webs 40 as described lend themselves to a single molding operation employing an injection mold which is split down the middle with bars mounted on each side and directed toward the center so that when opposite sides of the mold are closed, the bars will extend the complete width of the void in the mold and project into restrainer holes in the opposite side. These bars will form the voids or air pockets in the finished mold components which will extend to the outside or peripheral edge of the component and be sealed later with the closure strip. The two grooves formed around the perimeter of the midsole for interfitting engagement with the closure strip will be molded slightly deeper than the closure strip along the two sides to permit venting of air through the air pockets as described. In a separate molding operation, the closure strip is formed of the desired length, then is coated along the ridges, except on their inner faces, with a thermal setting rubber cement which will vulcanize or cure under the application of heat to seal the closure strip along the outer peripheral edge of the component.

Although the preferred form of midsole component has been described using a single air valve at each end which communicates with the upper air space or compartment at the heel and toe and which upper compartments communicate with lower compartments through the openings 28 and 29, it will be apparent that two air valves may be employed at each end to individually communicate with each upper and lower air space or compartment so as to separately regulate the amount of air pressure therein. It will be evident that the precise method employed in the construction of the midsole component may be suitably varied; also, materials selected in the composition of the different elements comprising the midsole component may vary widely dependng upon the particular application of use. Of course, different combinations of materials may be suitably employed in the construction of the midsole component wherein a resilient shock absorber member is required. In accordance with this invention, when a force, such as, the weight of a person is applied to the top surface of the resilient midsole, the ribs 19 and 20 push against the resilient diaphragm 18 which resists the initial force and, as the force increases, the air spaces between the ribs decrease in volume until the air compresses to completely stop the force. When the force is removed from the resilient midsole, the compressed air and the resilient diaphragm 18 have a rebounding effect, pushing up against the bottom of the foot.

It is therefore to be understood that the foregoing and other modifications and changes may be made in the construction and arrangement of parts comprising the preferred form of invention without departing from the spirit and scope thereof as defined by the appended claims.

I claim:

1. In a shoe, an impact-absorbing midsole member comprising spaced flexible closure layers including outer peripheral edges substantially coextensive with one another, a diaphragm extending intermediately between said spaced closure layers, an outer peripheral closure strip extending along said outer peripheral edges of said spaced closure layers to form a sealed air space between said closure layers, said sealed air space divided by said diaphragm into separate upper and lower air spaces, and a plurality of spaced, parallel support ribs extending through said upper and lower air spaces integral with said diaphragm and spaced closure layers, said closure strip having ridges interfitting with complementary grooves formed at opposite ends of said support ribs between said closure layers and said diaphragm.

2. In a shoe according to claim 1, said support ribs alternately extending in opposite directions away from unitary relation to said diaphragm throughout the substantial length and breadth of said closure layers.

3. In a shoe according to claim 1, said support ribs traversing the substantial width of said upper air spaces and interconnected between said diaphragm and closure layers.

4. In a shoe according to claim 1, including divider means for dividing said air space into separate toe and heel compartments.

5. In a shoe according to claim 4, in which an opening is provided in said diaphragm to establish communication through said diaphragm between said upper and lower air spaces on opposite sides of said diaphragm.

6. In a shoe according to claim 1, including means for adjustably controlling the air pressure between said spaced closure layers.

7. In a shoe according to claim 6, said means defined by regulating valves extending through said closure strip at opposite ends of said member, and divider means for dividing said air space into separate heel and toe compartments.

8. In a shoe according to claim 6, said ribs defining adjoining air pockets therebetween.

9. In a shoe according to claim 1, said diaphragm, spaced closure layers and support ribs defining a unitary resilient component.

10. In a shoe according to claim 1, at least selected of said ribs being of a width to form lateral clearance spaces between said ribs and closure strip to permit communication between adjoining air pockets formed between said ribs.

11. A midsole component for extension along the heel and sole region of footwear comprising in combination:

an elongated unitary resilient element comprising upper and lower flexible closure layers coextensive with one another, an intermediate diaphragm coextensive with and interposed between said upper and lower flexible closure layers, said upper and lower flexible closure layers and said diaphragm having outer peripheral edges substantially aligned with one another, a plurality of transversely extending support ribs extending in uniformly spaced relation to one another between said diaphragm and each of said upper and lower flexible closure layers, alternate support ribs extending in opposite directions from said diaphragm and integrally joined to said respective upper and lower closure layers throughout the substantial length and breadth of said midsole component, said support ribs terminating in free edges at opposite ends thereof to define uninterrupted air pockets between adjacent support ribs which remain open at opposite ends above and below said diaphragm, at least selected of said support ribs being of a length to terminate short of the outer peripheral edges of said upper and lower closure layers and said diaphragm to define lateral clearance spaces around the outer peripheral edges of said closure layers and said diaphragm;

an outer peripheral closure strip disposed in surrounding relation to said outer peripheral edges of said upper and lower closure layers and said diaphragm; and securing means for uniting said closure strip to the outer peripheral edges of said closure layers and said diaphragm to form a sealed heel and sole compartment between said closure layers and said closure strip.

12. A midsole component according to claim 11, said closure strip having ridges disposed in said lateral clearance spaces between said upper and lower closure layers and said diaphragm with the outer peripheral edge of said diaphragm received in an intermediate groove in said closure strip between said ridges.

13. A midsole component according to claim 11, said intermediate divider means defined by a partition rib between said heel and sole regions and joined at opposite ends to said closure strip to divide said midsole component into separate heel and sole compartments.

14. A midsole component according to claim 11, said adjustable control means defined by regulating valve means extending through said closure strip for selective introduction of air into the interior of said midsole component.

15. A midsole component according to claim 11, said support ribs dividing said air space into air pockets at spaced intervals throughout said midsole above and below said resilient diaphragm, at least selected of said air pockets communicating with one another through adjoining ones of said lateral clearance spaces.

* * * * *